United States Patent [19]

O'Brien

[11] 4,427,070

[45] Jan. 24, 1984

[54] CIRCULATING AND PRESSURE EQUALIZING SUB

[75] Inventor: Thomas B. O'Brien, Midland, Tex.

[73] Assignee: O'Brien-Goins Engineering, Inc., Midland, Tex.

[21] Appl. No.: 363,002

[22] Filed: Mar. 29, 1982

[51] Int. Cl.[3] ..... E21B 34/10

[52] U.S. Cl. ..... 166/317; 166/318; 137/70

[58] Field of Search ..... 166/317–319, 166/321, 386, 323–325, 373, 374; 137/70, 71, 68 R; 285/2–4, 317

[56] References Cited

U.S. PATENT DOCUMENTS

| | | | |
|---|---|---|---|
| 2,998,075 | 8/1961 | Clark, Jr. | 166/318 |
| 3,273,650 | 9/1966 | Alexander et al. | 166/317 |
| 3,789,926 | 2/1974 | Henley et al. | 166/318 |
| 4,031,957 | 6/1977 | Sanford | 166/317 X |
| 4,176,717 | 12/1979 | Hix | 166/318 |
| 4,298,218 | 11/1981 | Britch | 285/317 X |

*Primary Examiner*—Ernest R. Purser

*Assistant Examiner*—Thuy M. Bui

*Attorney, Agent, or Firm*—Gunn, Lee & Jackson

[57] ABSTRACT

A circulating sub is provided which is adapted for connection in a production tubing string of a flowing well and which defines a flow passage through which production fluid is enabled to flow. The body structure of the sub defines an equalizing port in communication with the annulus between the tubing and casing of the well, which port is normally closed by means of a sleeve valve. An actuating plug is dropped through the production tubing after shutting in the well and descends to the level of the circulating sub where it seats on the closed valve. Application of fluid pressure through the tubing develops sufficient pressure differential across the valve and plug to force the valve to its open position to thus communicate the tubing and annulus for pressure equalization. The plug member incorporates a check valve which permits accurate balancing of kill fluid to well pressure to thus permit emergency killing of the well without causing damage to the production formation.

13 Claims, 9 Drawing Figures

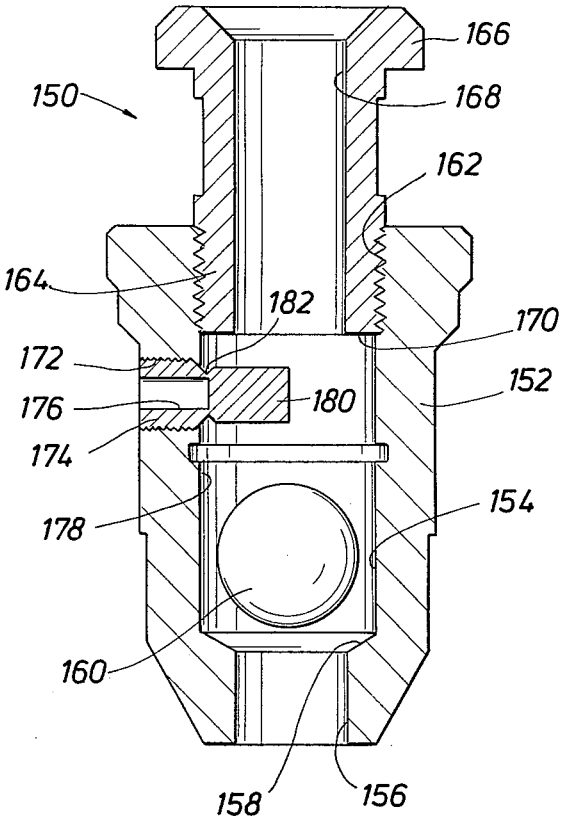
FIG.7
FIG.9
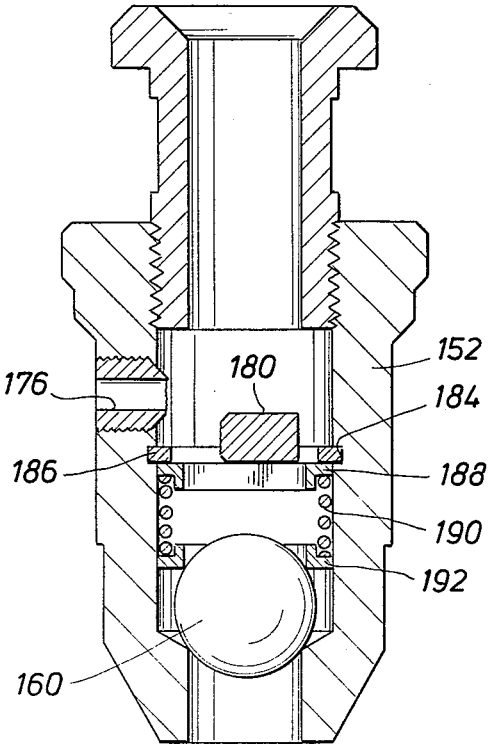
FIG.8
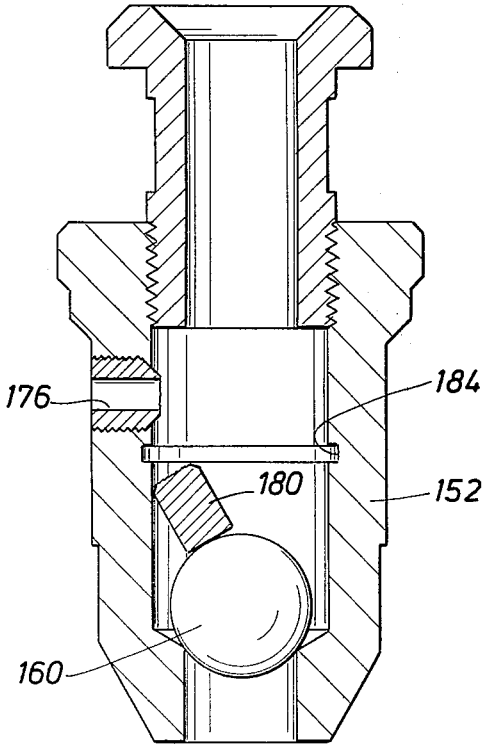

CIRCULATING AND PRESSURE EQUALIZING SUB

FIELD OF THE INVENTION

This invention relates generally to production systems for producing petroleum products such as natural gas, oil, distillate and other liquid and gaseous materials from subsurface production zones. More specifically, the present invention is directed to the provision of a circulating sub which is connected in the production tubing string above the level of a packer and which provides a facility for emergency killing of the well simply through application of pressure through the tubing and without any requirement for wireline tools, lifting equipment or setdown equipment such as ordinarily required for such purpose.

BACKGROUND OF THE INVENTION

After a well has been drilled to a subsurface production zone which is found to contain paying quantities of petroleum products such as natural gas, oil, distillate, etc., the well is completed by extending production tubing through the casing lining the well bore to the level of the production zone. Typically, packers are set in the casing and between the casing and tubing to isolate the production zone and to ensure that pressurized fluid from the production zone can pass only through the production tubing to a wellhead control system located at the surface. To prepare the production zone for optimum production of petroleum products, it is almost always desirable to circulate washing fluid into the well which frequently contains chemical constituents such as acid, for example, for chemical treatment of the production zone. After well completion has been accomplished and production has continued for an extended period of time, it is sometimes appropriate to circulate fluid into the well for the purpose of enhancing production, cleaning the tubing or providing other desirable well treating characteristics. Various acids and chemicals are typically employed for such purpose.

At times during the life of a well, it is necessary to temporarily kill the well to permit certain servicing operations or to permit repair or replacement of production equipment. In some cases, emergency conditions arise where it becomes necessary to shut the well in and kill it within a relatively short period of time.

Wells are typically killed by pumping kill fluid of various suitable liquid forms into the well to the extent that the pressure of the formation is overcome by the hydrostatic head of the column of kill fluid standing above the formation. A small amount of kill fluid may enter the formation and function to develop a seal that isolates the pressure of the formation from the well bore. After the well has been killed, production equipment such as packers, production tubing and other equipment may be safely removed from the casing for repair or replacement. After the production equipment has been reinstalled in the well casing, production is re-established by circulating a cleaning medium into the well which removes the kill fluid and re-establishes fluid communication between the production formation and the casing. It is difficult to determine just how much kill fluid must be pumped into a well to safely kill the well. In many cases, sufficient amounts of kill fluid are pumped into the formation that the formation can be permanently damaged to the extent that adequate production from the formation cannot be re-established. It is, of course, desirable to provide a system for safely killing the well and which also ensures against the likelihood of causing damage to the production formation by excessive kill fluid.

At times, it is desirable to kill a well without allowing kill fluid to come into contact with the producing formation. In this case, the tubing and packer are allowed to remain in place while repair services are conducted.

DESCRIPTION OF THE PRIOR ART

Devices for equalizing tubing and annulus pressures have been developed for the purpose described herein. For example, Baker Completion Systems manufactures and markets a product that is referred to as the Model "S" Unloading Sub, further identified as Product No. 671-11. This product incorporates an internal slide valve which incorporates a shear screw arrangement to maintain the sub in either the open or closed position as selected. For downward valve movement, it is necessary to apply set down weight to shear the screw and shift the valve of the unloading sub to its closed position. To move the valve element upwardly, it is necessary that upstrain be applied to shear the screw and move the valve element to its upper position. In either case, it is necessary that well service equipment be provided having the capability of applying set down weight or upstrain for the purpose of valve operation. Such equipment is not ordinarily located at the well site and must be moved on location for the purpose of achieving equalizing tubing and annulus pressures. Under many emergency conditions, it is highly desirable that suitable equipment be readily available to accomplish killing of the well as such is required.

In most cases, kill fluid pumps are readily available and can be brought to the well site on short notice in the event emergency killing of the well is desired. Pumps for circulating kill fluid are also capable of applying sufficient pressure to operate well safety equipment. Equipment for upstrain or setdown operations, however, is not so readily available. It is desirable, therefore, to provide a system for killing a well wherein the prime motive force for the well killing operation is in the form of pump generated fluid pressure.

SUMMARY OF THE INVENTION

It is a primary feature of the present invention to provide a novel circulating sub for wells which permits normal passage of fluid therethrough and which, when desired, may be activated by fluid pressure to thus open communication between production tubing and the annulus of a well for equalization of tubing and annulus pressures.

It is an even further feature of this invention to provide a novel circulating sub for wells which may be activated without utilization of mechanical downhole equipment such as wireline tools and which does not require application of upstrain or setdown forces to achieve controlled operation thereof.

It is also a feature of this invention to provide a novel circulating sub for wells which is capable of being positively maintained in the closed position thereof for extended periods of time, thus isolating the production flow passage of the tubing from the annulus between the tubing and casing.

It is an even further feature of this invention to provide a novel circulating sub having the capability of shifting to a position balancing tubing and casing pressures solely responsive to pressure induced forces that may be generated by means of conventional oil field service pumps and other pressure supply equipment.

Among the several features of this invention is contemplated the provision of a novel circulating sub that also functions as a safety means for accomplishing killing of a well when desired.

It is an even further feature of this invention to provide a novel circulating sub capable of well killing operations and wherein means is provided to monitor the requirement for well killing fluid to thus provide for adequate killing of the well without inducing damage to the production formation.

Another important feature of this invention is to provide a mechanism for killing wells that permits kill fluid to be pumped into the tubing-casing annulus of a well and yet precludes entry of kill fluid into the portion of the tubing below the circulating sub, thereby insuring that the kill fluid does not contact the producing formation.

Briefly, a circulating sub incorporating valve controlled tubing and annulus pressure balancing may conveniently take the form of a tubular body having an upper pin connection adapted for threaded connection within the box at the lower end of a section of production tubing. The tubular body is formed internally to define a valve chamber within which is positioned a tubular sleeve valve that is sealed with respect to an internal cylindrical surface defined by the body. The tubular sleeve valve defines a flow passage through which flowing fluid may pass during production and through which tools may be passed during certain well servicing operations. The sleeve valve functions as a selective closure for an equalizing port that is formed in the wall structure of the body for the purpose of selective equalization of fluid pressure within the production tubing with the pressure in the annulus between the tubing and well casing. The sleeve valve normally closes the equalizing port and is retained in its closed position by a shear pin that is secured to the body and extends into the valve chamber.

The sleeve valve also defines a landing shoulder that is engaged by a mating shoulder formed on a valve actuator plug. The valve actuator plug defines a flow passage encapsulating a ball type check valve. The check valve unseats to permit flow through the plug as the plug is dropped into the production tubing and descends to the level of the sleeve valve. After the valve actuating plug has reached the sleeve valve and becomes properly seated thereon, fluid pressure is applied through the production tubing from the surface. This fluid pressure causes the ball check valve to become tightly seated, thus permitting application of fluid pressure against the exposed combined surface area of the sleeve valve and valve actuating plug for development of a force inducing pressure differential. Upon development of sufficient pressure differential, the resulting force acting upon the sleeve valve causes the shear pin to become sheared, thus releasing the sleeve valve for movement to its open position. In the open position of the sleeve valve, the equalizing port is exposed to the tubing thereby permitting fluid communication between the production tubing and the annulus between the tubing and casing. With the sleeve valve in the open position and pressure equalized between the tubing and annulus, kill fluid may be pumped into the production tubing against the influence of formation pressure. The kill fluid is pumped through the tubing above the circulating sub and flows through the equalizing port and into the tubing-casing annulus above the packer to kill the well. The equalizing valve mechanism can preclude entry of the kill fluid into the tubing below the circulating sub, thereby insuring against contact between the kill fluid and the producing formation. In this manner, the well may be safely killed and the producing formation will be protected against damage, thus permitting appropriate well service operations to again render the well to safe operating conditions.

Other and further objects, advantages and features of the present invention will become apparent to one skilled in the art upon consideration of this entire disclosure. The form of the invention which will now be described in detail, illustrates the general principles of this invention but it is to be understood that this detailed description is not to be taken as limiting the scope of the present invention.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiment thereof which is illustrated in the appended drawings which drawings form a part of this specification.

It is to be noted, however, that the appended drawings illustrate only a typical embodiment of this invention and are, therefore, not to be considered limiting of its scope, for the invention may admit to other equally effective embodiments.

IN THE DRAWINGS

Figure 1:
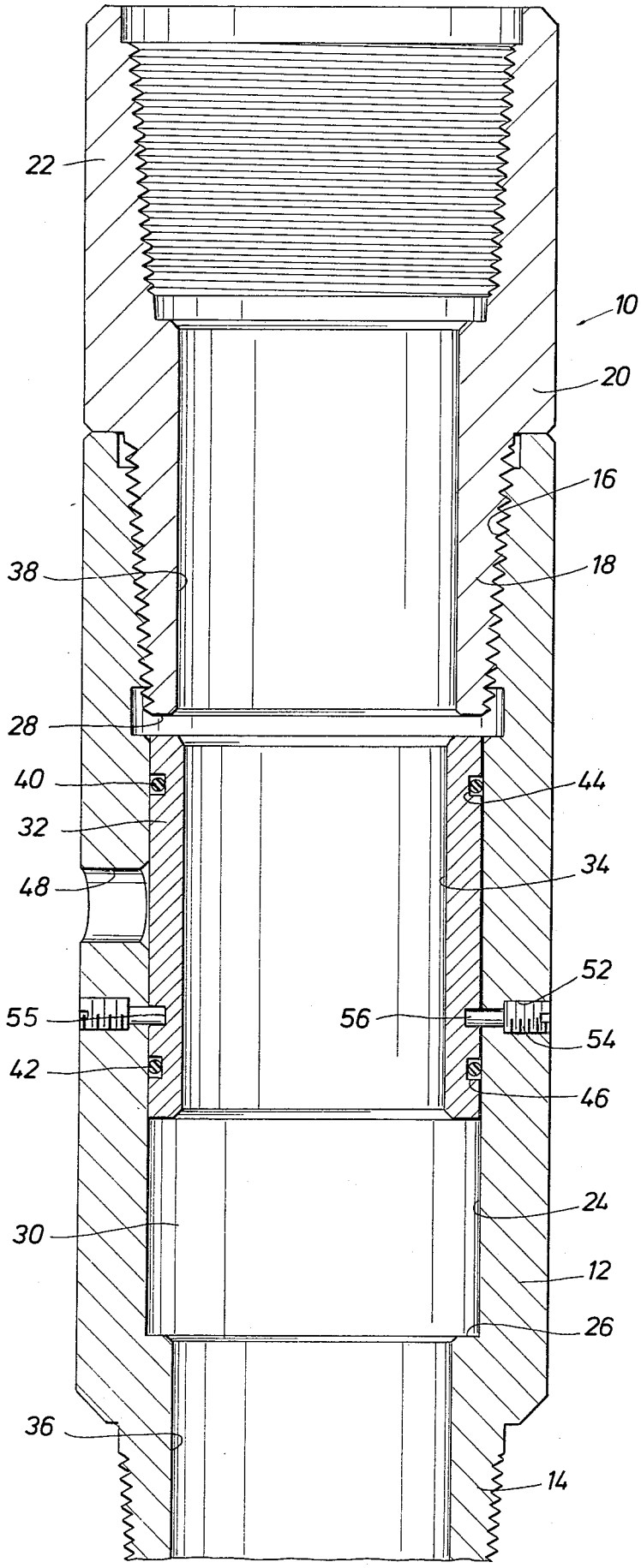

FIG. 1 is a sectional view of a circulating sub that is constructed in accordance with the present invention and which illustrates the equalizing port control valve thereof in its normally closed and locked position for normal well production operations.

Figure 2:
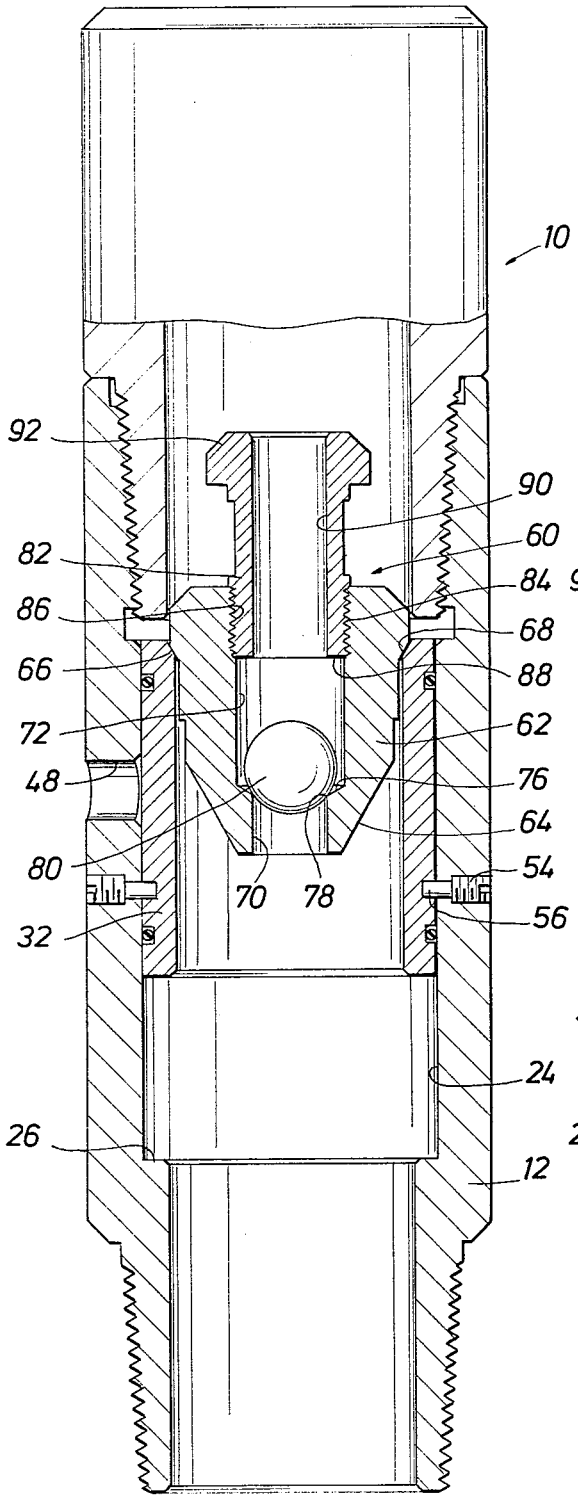

FIG. 2 is a sectional view of the circulating sub of FIG. 1 illustrating a valve actuating plug in seated position with the equalizing port control valve and with the control valve in its closed and locked position and also illustrating a modified embodiment.

Figure 3:
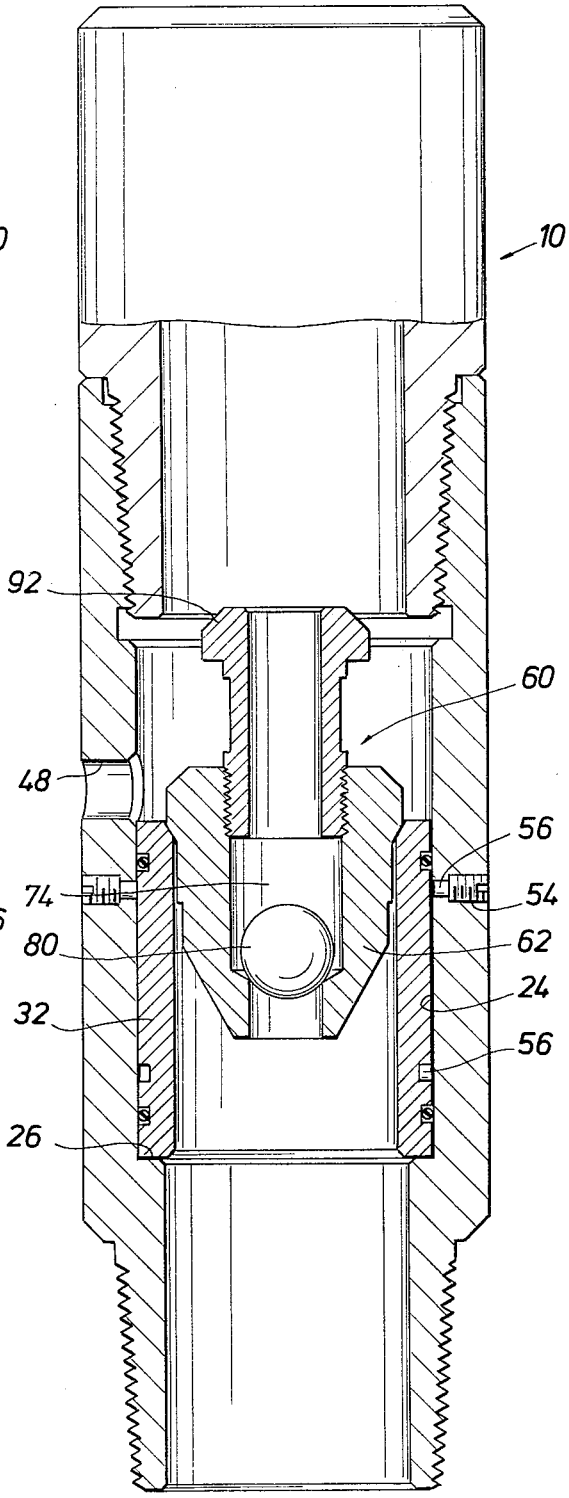

FIG. 3 is a sectional view similar to that of FIG. 2 illustrating the equalizing port control valve following pressure induced forcible movement thereof to its open position by means of the valve actuator plug.

Figure 4:
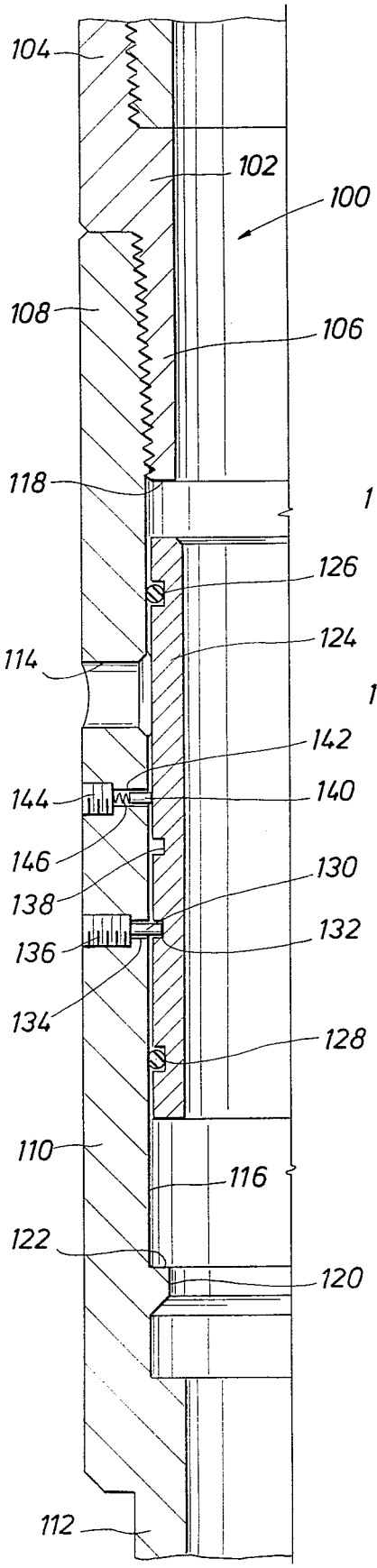

FIG. 4 is a quarter section view of an equalizing valve mechanism representing a modified embodiment of this invention and showing the sleeve type equalizing valve locked in its closed position.

Figure 5:
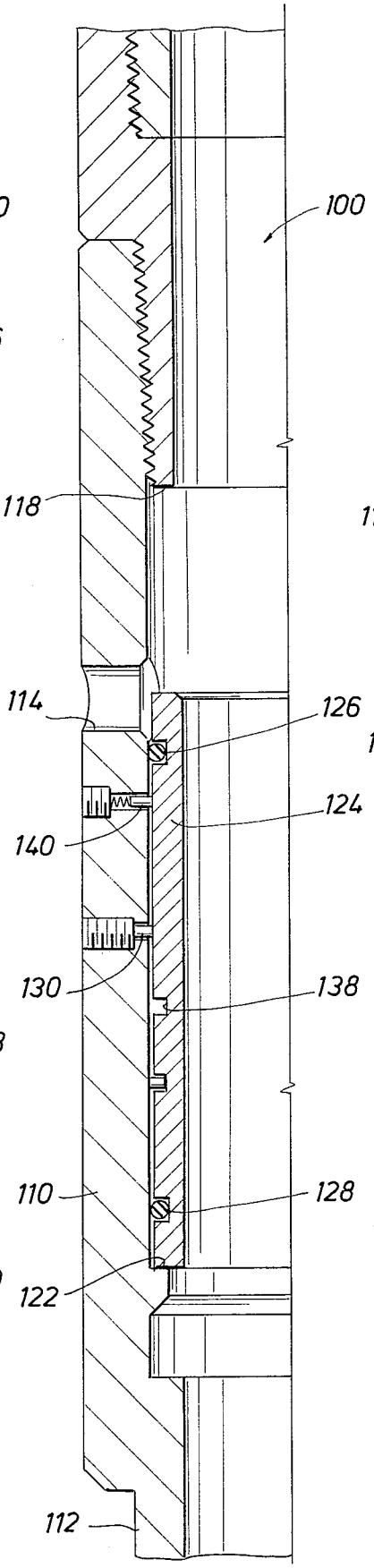

FIG. 5 is a quarter section view of the equalizing valve mechanism of FIG. 4 showing the sleeve valve in its open position.

Figure 6:
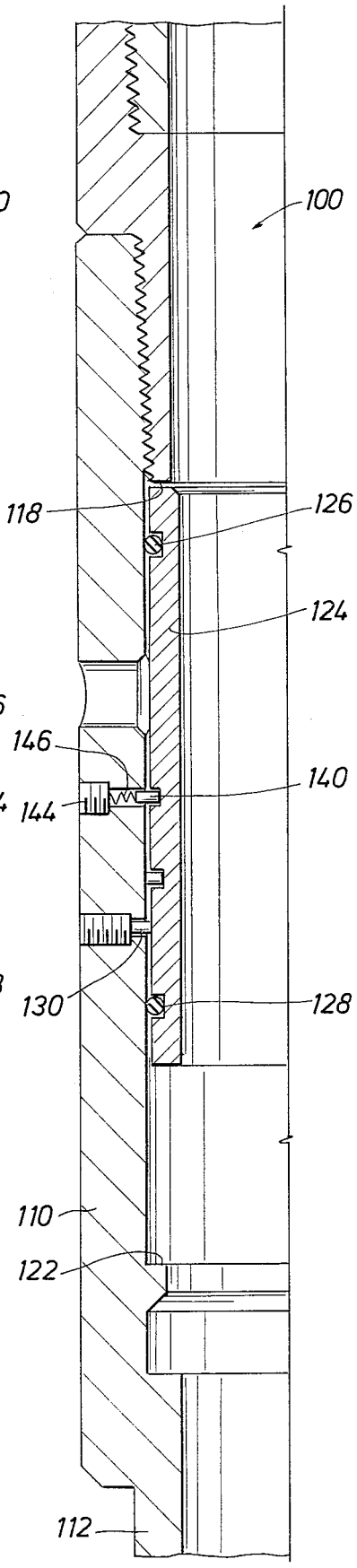

FIG. 6 is a quarter section of the valve of FIG. 4 showing the sleeve valve thereof in the closed and second locked position thereof.

FIG. 7 is a sectional view of a valve operating plug representing an alternative embodiment of this invention.

FIG. 8 is a sectional view similar to that of FIG. 7 and showing the equalizing plug with the equalizing bypass passage open.

FIG. 9 is a sectional view of a valve operating plug member representing another embodiment of this invention wherein the spherical check valve thereof is spring loaded.

DETAILED DESCRIPTION OF PREFERRED EMBODIMENT

Referring now to the drawings and first to FIG. 1, a circulating sub capable of selective tubing and annulus pressure balancing and constructed in accordance with the present invention is illustrated generally at 10. The circulating sub 10 incorporates an elongated tubular body structure 12 having an externally threaded pin connection 14 at the lower extremity thereof which is adapted to be received within the internally threaded box extremity of a section of production tubing. At its opposite or upper extremity, the tubular body 12 is formed to define internal threads 16 that receive the externally threaded lower portion 18 of an upper body section 20. The upper body section 20, in turn, defines an internally threaded upper box portion 22 that is adapted to receive the lower externally threaded pin connection of a section of production tubing. The circulating sub 10 is, therefore, connected into a string of production tubing and is typically located above the packer that forms a seal between the production tubing and well casing.

When necessary, for purposes of safety, to kill the well or for other desirable purposes, it is appropriate to establish communication between the production tubing and the annulus between the tubing and casing for the purpose of equalizing tubing pressure and annulus pressure. In the case of the present invention, this feature is accomplished by forming the tubular body structure 12 to define an internal cylindrical wall surface 24 having an annular stop shoulder 26 at the lower extremity thereof. At the opposite end of the cylindrical wall surface 24, the lower threaded pin portion 18 of the upper body section 20 defines an upper stop shoulder 28 that opposes stop shoulder 26. The cylindrical wall surface 24 and the stop shoulders 26 and 28 cooperate to define a generally cylindrical valve chamber 30. Within the valve chamber 30 is provided an elongated sleeve valve 32 of generally cylindrical form which defines a flow passage 34 in communication with passage section 36 and 38 defined respectively by the tubular body 12 and the upper body section 20. The passage sections 36 and 38 are of such dimension as to be substantially coextensive with respect to the flow passages of the tubing sections to which they are respectively connected.

The sleeve valve element 32 is sealed with respect to the cylindrical surface 24 of the tubular body by means of upper and lower annular sealing elements 40 and 42 that are retained within respective annular seal grooves 44 and 46 formed in the upper and lower portions of the sleeve valve. In the closed position of the sleeve valve, as shown in FIG. 1, the sealing elements 40 and 42 are positioned on opposite sides of an equalizing port 48 that is formed in the tubular body 12 adjacent the upper portion of the valve chamber 30. The sealing elements 40 and 42, which may conveniently take the form of O-ring type seals, chevron seals or seals of other suitable form, function to isolate the equalizing port 48 from the valve chamber 30 and thus prevent fluid communication between the annulus and production tubing. With the sleeve valve thus positioned, flow of production fluid is permitted through the production tubing and the respective flow passage sections and valve chamber defined by the circulating sub 10.

It is desirable that the sleeve valve 32 be positively maintained in the closed position thereof, thus preventing equalizing of annulus and tubing pressures to prevent inadvertent opening of the sleeve valve during handling, installation and normal service conditions. It is desirable that the sleeve valve be capable of controlled movement to the open position thereof when opening movement is desired. To accomplish these features, the sleeve valve 32 is formed to define an annular locking groove 55. The tubular body 12 is formed to define an internally threaded receptacle 52 within which is received an externally threaded locking element 54. The locking element defines a reduced diameter pin portion 56 capable of being sheared upon application of sufficient downward force to the sleeve valve 32. The locking element 54 may be composed of any suitable material such as plastic, metal, etc. capable of entering the locking groove 55 and restraining the sleeve valve 32 against movement until sufficient force is induced to cause the sleeve valve 32 to shear the pin portion 56. The locking elements and its shear pin may be formed of a material such as brass which yields to shear forces upon the application of a pressure differential, for example in the order of 250 p.s.i. acting on an annular surface area encompassed by the upper sealing element 40.

In the alternative, the valve restraining element may take the form shown at the left hand portion of FIG. 2 which comprises one or more locking ball detent means 57 being spring loaded by compression spring means 59. The ball detent means will release the valve element at the desired pressure and may be relatched simply by moving the sleeve valve 32 upwardly to the position shown in FIGS. 1 and 2.

It is desirable to provide means for application of sufficient force to the sleeve valve 32 to shear the pin 56 and then induce downward movement of the sleeve valve to its open position. In accordance with the present invention, and as illustrated in FIG. 2, a valve actuator plug element is illustrated generally at 60 which incorporates a plug body 62 having a tapered lower portion 64 which serves as a guide to permit the plug body to descend through the flow passage of the production tubing to the equalizer sub 10. It should be born in mind that the plug element 60 is only one of a variety of plug designs that have the capability of developing a fluid blocking seal at the equalizer sub and allowing pressure induced operation of the equalizer valve 32. Other plug designs may include solid plugs, balls, low density plugs (for gas wells), plugs with minimum or maximum clearance to the tubing and other special applications determined by particular well conditions and well fluid of differing characteristics. The plug body 62 is formed to define an annular shoulder 66 of tapered form which is adapted for seating against an annular tapered landing surface 68 defined internally of the upper portion of the sleeve valve 32. The plug body is capable of descending through the tubing string but once landed against the landing surface 68 of the sleeve valve, it cannot descend further.

To permit the valve actuator plug to descend through the tubing string which may contain liquid, the plug body 62 is formed to define a flow passage 70, a portion of which is enlarged as shown at 72, to form a valve chamber 74. A tapered annular valve seat surface 76 intersects the flow passage 70 to define an annular seating edge 78. A spherical valve element 80 is movably contained within the valve chamber 74 and is adapted for seating engagement against the circular edge 78. The valve element 80, which may be composed of hard material such as steel, functions as a check valve and is capable of pressure responsive movement within the valve chamber 74. To permit upward flow of fluid through the flow passage 70 of the plug body as the plug member moves downwardly through the tubing string, the valve element 80 will be unseated thereby allowing the flow of fluid around it as the fluid flows through the flow passage. In the absence of upward flow of fluid through the plug, the weight of the valve element, together with pressure acting in the opposite direction, causes the valve element to become seated with respect to the circular sealing edge 78 and thus prevents downward flow of fluid relative to the plug body. When the valve 80 is seated and pressure is applied through the production tubing, this pressure acts on the combined exposed surface area of the valve actuating plug, its spherical valve and the sleeve valve to thus develop a pressure differential that induces valve actuating force to the sleeve valve 32.

To retain the spherical valve element 80 within the valve chamber 74, a valve retainer 82 is provided having an externally threaded portion 84 that is received within an internally threaded upper portion 86 of the plug body 62. The valve retainer 82 defines an annular retainer shoulder 88 and forms a flow passage 90 through which fluid flows as the plug member descends through the production tubing. The shoulder 88 functions as a stop to ensure that the spherical valve 80 is retained within the valve chamber 74. The upper portion for the valve retainer 82 is formed to define a conventional fishing neck 92 which permits retrieval of the plug by means of conventional wire line well service equipment. An alternative plug design, without a free floating internal check valve, could be moved upwardly from its seated position by flowing well fluids. Upon being forced above the equalizing and circulating port, reverse of circulation will force the plug upwardly through the tubing to the surface. Another alternative design could employ a valve actuating plug that is capable of becoming latched or otherwise secured to the valve element. By using a wire line system or reverse pumping, the plug could be used to shift the valve element to the closed position. The plug element could then be retrieved by jarring upwardly with the wire line tool to release the plug from the valve element and then retrieve the plug with the wire line.

In the operating condition of the equalizer sub, the valve element 32 is positioned as shown in FIG. 1 and is locked in place by means of the locking element 54 with the shear pin portion 56 thereof positioned within the locking groove 55. Thus, flow of production fluid from the formation will pass through the tubing below the equalizer valve and will pass through the registering passages of the equalizer valve into the upper tubing of the tubing string. Assuming that it should become desirable to equalize annulus pressure and tubing pressure, such as for killing the well in preparation for well servicing, valves are manipulated at the wellhead control to cease the flow of production fluid through the tubing. After flow of production fluid has been stopped, a valve actuator plug element 60 is inserted into the tubing and is allowed to descend to the level of the equalizer sub. The tapered lower nose portion 64 guides the plug element as it descends through the tubing. As the plug reaches the valve element 32 of the equalizer sub, the annular shoulder 66 of the plug seats against the landing surface 68, thus precluding further descent of the plug. During descent of the plug through the tubing, the valve element 80 becomes unseated by pressure differential to permit relative flow of fluid through the flow passage 70 especially under circumstances where the production fluid is a liquid.

After the valve actuator plug has become landed as shown in FIG. 2, conventional pump means is employed to introduce fluid pressure into the production tubing above the level of the equalizer sub. This tubing pressure acts upon the combined surface areas of the valve actuator plug, spherical valve and sleeve valve to thus develop a pressure differential and a resultant force acting downwardly upon the sleeve valve. As this resultant force reaches its shearing magnitude, for example, upon application of about 250 p.s.i. pressure differential, the pin portion of the valve locking element will become sheared thereby releasing the sleeve valve for movement to its open position as shown in FIG. 3. At the open position of the sleeve valve, the equalizing port 48 is uncovered, thereby communicating the annulus with the tubing. Pressure in the annulus and tubing is thus equalized by downward shifting of the sleeve valve. Under this balanced pressure condition of the well, kill fluid is pumped into the tubing and through the equalizing port 48 into the tubing-casing annulus to kill the well. The plug element 60, being seated in sealed relation against the tapered seat surface 68 of the slide valve element, precludes entry of kill fluid into the portion of the tubing below the circulating sub thereby providing means, if desired, for insuring that kill fluid does not contact the producing formation.

It is desirable to ensure that sufficient kill fluid is pumped into the formation to kill the well but that pumping of kill fluid be minimized to the extent that the formation is not permanently damaged by the kill fluid. Ordinarily, it is extremely difficult to determine the precise amount of kill fluid necessary for killing the well. Therefore, in many cases, excess kill fluid is pumped into the formation thus damaging the formation to the extent that maximum production cannot thereafter be achieved. In accordance with the present invention, the formation can be protected against contact by kill fluid and the pressure responsive valve actuating plug provides an efficient system for determining adequate killing of the well without damaging the formation by excessively injecting it with kill fluid to the extent that the kill fluid cannot be efficiently removed to re-establish maximum communication between the well bore and formation. The spherical ball check valve within the valve actuator plug element will tend to become unseated by formation pressure until the well has become balanced. When the spherical check valve remains closed upon reduction of tubing pressure, an indication is provided that the formation has received enough kill fluid for killing the well. Pumping of kill fluid is, of course, discontinued as soon as the well has been properly killed.

As the production tubing is withdrawn from the casing for servicing, the sleeve valve remains in the open position thereof thereby allowing any liquid contained within the tubing to drain through the equalizing port. If desired, the tubular body 12 may be formed to define a plurality of equalizing ports to permit additional equalizing port and drain port area.

After the equalizing sub has been removed from the well, it may again be placed in service by shifting the sleeve valve 32 to the closed position thereof and by replacing the sheared locking element 54 with a new locking element. The circulating sub is then reset and may again be connected to production tubing and run into the well for another period of service.

A situation could arise where it becomes desirable to leave the tubing in the well and shift the equalizer valve to its closed position. In this case, a wire line shifting tool may be utilized to engage the valve 32 and shift it upwardly to the closed position. The equalizer valve 32 may be provided with a releasable latch instead of a shear pin to thus enable the slide valve to be again latched in its closed position.

Through employment of the circulating sub of this invention, a well may be killed under emergency conditions without necessitating the provision of well service equipment such as wireline equipment and upstrain and setdown equipment such as is typically necessary for activation of well balancing systems. By providing a single emergency pump in oil field conditions, a well in need of service may be very quickly shut down and killed through the use of readily available equipment. After the emergency condition of the well has been satisfied by shutting in and killing of the well, other well service equipment may be brought to the well site under more leisurely conditions in order to accomplish well servicing.

After a circulating valve mechanism has been operated to shift the valve to its open position allowing communication between the tubing string and annulus, it may become desirable to again close the valve and retain it in its closed position without removing the tubing and valve mechanism from the well. Accordingly, a valve mechanism accomplishing this feature is identified generally at 100 in FIGS. 4, 5 and 6. In FIG. 4 the valve mechanism is shown in its closed position with its sleeve valve being secured by means of a shear pin. In FIG. 5 the valve mechanism is shown in its open position subsequent to shearing of the shear pin. In FIG. 6 the valve mechanism is shown again in its closed position with the sleeve valve thereof secured in a closed position by means of a secondary shear pin.

Referring now particularly to FIG. 4, the circulating valve mechanism 100 includes an upper sub portion 102 defining an internally threaded box connection 104 adapted to receive the lower externally threaded pin portion of a section of production tubing to which the equalizing valve mechanism is interconnected. The lower portion of the sub 102 defines an externally threaded pin connection 106 which is adapted to be received within an internally threaded box connection 108 defined at the upper portion of a valve body structure 110. The lower portion of the valve body 110 defines an externally threaded pin connection 112 adapted to receive the internally threaded box connection at the upper portion of an adjacent section of production tubing.

Intermediate the extremities of the valve body section 110, an equalizing port 114 is defined for the purpose of permitting controlled communication between the tubing string and the annulus between the tubing string and casing.

Internally of the valve body 110 is formed a cylindrical valve slide surface 116 having stop shoulders at each extremity thereof. A stop shoulder 118 is defined by the lower extremity of the sub 102. A lower stop shoulder 120 is formed within the valve body 110 and provides an upwardly directed circular stop surface 122.

To control the open and closed conditions of the equalizing port 114, a slide valve 124 of cylindrical form is positioned for movement within a valve receptacle defined between the stop shoulders 118 and 122. The slide valve 124 is of generally cylindrical form and includes upper and lower sealing elements 126 and 128 which maintain sealing engagement between the slide valve and the cylindrical surface 116 defined within the valve body. In the position shown in FIG. 4 the slide valve 124 is positioned such that the sealing elements 126 and 128, which may be O-rings or of any other suitable form, are positioned on either side of the equalizing port 114. Hence, the slide valve 124 is in the closed position thereof as shown in FIG. 4.

As further shown in FIG. 4, the slide valve 124 is maintained secured in the closed position thereof by means of a shear pin 130 which is received within a circular groove 132 formed in the outer periphery of the slide valve 124. The shear pin 130 is retained in position within a pin opening 134 by means of a retainer element 136 that is in turn received within an internally threaded opening formed in the valve body 110. If desired, the shear pin 130 may be made a part of the retainer element and is thus positioned within the opening 134 and groove 132 upon threading the retainer element in place within the retainer opening.

It should be noted that the position of the slide valve 124 as shown in FIG. 2 is such that a space exists between the upper extremity of the slide valve and the stop shoulder 118. The slide valve 124 is opened in the same manner as described above in connection with FIGS. 1–3 with the valve element being moved downwardly by means of an equalizing plug such as shown in FIGS. 2 and 3 or as shown in FIGS. 7 and 8. After the slide valve has been shifted downwardly to the FIG. 5 position thereof, the sealing element 126 will move across the equalizing port 114 thereby allowing communication between the tubing and annulus.

Subsequently, it may be desirable to again shift the slide valve 124 to its closed position and to retain it in the closed position thus placing the tubing and annulus out of communication and permitting further well production without requiring removal of the tubing and equalizing valve as in the case of FIGS. 1–3. Accordingly, the slide valve 124 is formed to define a second locking groove 138 which is spaced from the locking groove 132. A second shear pin 140 extends through a shear pin opening 142 in the valve body 110 and is retained by means of a retainer element 144 received within an internally threaded retainer opening. The shear pin 140 is capable of being retracted to a position within the shear pin opening 142 in the manner shown in FIG. 4. The shear pin 140 is urged toward the slide valve 124 by means of a compression spring 146. Upon registry of the second locking groove 138 with the shear pin opening 142, the shear pin 140 will be moved into the groove 138 thus again locking the slide valve against subsequent movement. This relocked position is shown in FIG. 6. As shown in FIG. 6, the slide valve 124 is in its closed position and is locked against vertical movement by means of the second shear pin 140. The slide valve 124 may again be opened by shearing the second pin 140 in the manner described above. After the second shear pin 140 has been sheared to reopen the valve then the slide valve will be incapable of being again locked in its closed position. The valve mechanism of the present invention therefore provides for initial valve opening to communicate the tubing with the annulus of the well and then allows for subsequent relocking of the valve in its closed position. Thereafter, the valve may again be opened simply by shearing the second shear pin. After this has been done, the tubing string and the valve mechanism must then be removed from the well and provided with new shear pins to again restore it to its initial condition as shown in FIG. 4.

As shown in FIGS. 2 and 3 the plug member 60 is provided with a valve element 80 that seats against a seat surface to prevent downward flow of fluid past the valve. This feature permits sufficient introduction of pressure into the tubing string above the plug member to enable development of sufficient force to shear the locking pin 56. When a plug member is received by means of wireline retrieval equipment attached to the fishing neck 92, the spherical valve element 80 will of course remain seated. If a substantial volume of production fluid lies above the level of the plug member 60 the plug member may be difficult to remove from the tubing string because of its rather close fit with respect to the inner wall surface of the tubing string. In other words, production fluid must flow around the plug member in order to allow the plug member to be removed from the tubing.

In some cases, it may be desirable to provide a flow path through the plug member which bypasses the spherical valve member and thus allow easy removal of the plug member from the tubing string. Accordingly, a plug member representing a modified embodiment of the present invention may conveniently take the form illustrated generally at 150 in FIGS. 7 and 8. The plug member 150 incorporates a plug body 152 having an outer configuration of similar form as compared to the plug member 60 of FIGS. 2 and 3. The plug body 152 is formed to define a valve chamber 154 which is intersected by a passage 156 of smaller diameter in such a manner as to define an annular tapered sealing surface 158. The sealing surface 158 is engaged by means of a spherical valve element 160 which is movably retained within the valve chamber 154. The spherical valve element 160 functions as a check valve allowing upward flow of fluid through the plug member but preventing downward flow therethrough. The upper portion of the plug body is formed to define an internally threaded opening 162 which is adapted to receive the externally threaded lower portion 164 of a fishing neck 166. The fishing neck 166 defines an internal passage 168 which is in communication with the valve chamber 154. The lower extremity of the fishing neck defines a circular shoulder 170 which functions to entrap the spherical valve element 160 within the valve chamber 154.

In order to provide for bypass flow of fluid through the plug member 150 the plug body 152 is formed to define an internally threaded opening 172 which communicates the valve chamber 154 with the annulus defined between the plug member and the tubing. An equalizer plug 174 provided with an externally threaded portion is received within the threaded opening 172 and defines a blind passage 176 extending through the threaded portion of the equalizer plug and slightly past the inner surface 178 of the valve chamber 154. The equalizer plug incorporates a transverse projecting portion 180 which projects well into the valve chamber 154 and in registry with the passage 168 of the fishing neck 166. Any object passing through the passage 168 of the fishing neck would come into engagement with the transverse extending portion 180 of the equalizer plug. The equalizer plug may be of integral form with the transverse projecting portion 180 thereof being separated from the outer threaded portion thereof by means of a circular groove 182 that weakens the plug and defines a frangible portion. Upon the passage of a suitable tool through the passage 168 of the fishing neck, the tool may be brought into forcible contact with the transverse projecting portion 180 with sufficient force to fracture the equalizer plug along the weakened grooved portion 182. When the equalizer plug fractures the break occurs in such a manner that the blind passage 176 is opened at the break line in the manner shown in FIG. 8. The projecting portion 180 then falls into the valve chamber 154 but is of sufficient dimension that it does not interfere with normal operation of the spherical valve member 160.

In some cases it may become desirable to provide the spherical valve member 160 with preloading to retain it seated against the tapered sealing surface 158 except under circumstances where upward flow of fluid is occurring. In such case, the plug body 152 is formed to define an internal retainer groove 184 within which is received a suitable spring retainer element. The spring retainer element provides an upper stop for retention of a compression spring having the lower extremity thereof bearing against the spherical valve element 160. The spring retainer element seated within the retainer groove 184 may form an upper spider that prevents the transverse projecting portion 180 from descending to the level of the spherical plug member 160. In such case, the plug mechanism may conveniently take the form shown in FIG. 9 where a retainer element 186 is shown to be located within the retainer groove 184. The retainer element 186 may conveniently be in the form of a conventional snap ring or any other suitable form. An upper spring retainer 188 is positioned within the valve chamber 154 and provides an upper stop for a compression spring 190. A lower spring retainer element 192 provides support for the lower extremity of the compression spring 190 and bears against the spherical valve element 160. The lower retainer element 192 is segmented in such a manner as to define an adequate flow path past the spherical valve element.

The upper spring retainer element 188 may be in the form of a spider defining openings of sufficiently small dimension to prevent the frangible projecting portion 180 from descending to the level of the valve element 160. The spider construction however allows sufficient flow path for adequate flow through the plug member as the plug member descends through the tubing string.

In view of the foregoing, it is evident that this invention is one well adapted to attain all of the objects and features hereinabove set forth together with other features which are inherent in the description of the apparatus itself. It will be understood that certain combinations and subcombinations are of utility and may be employed without reference to other features and other subcombinations. This is contemplated by and is within the scope of the present invention.

What is claimed is:

1. A circulating sub for installation as a part of the tubing string above the packer sealing the tubing string with respect to the well casing, said circulating sub comprising:

(a) body means adapted for threaded connection to joints of tubing, said body means defining a circulating passage in communication with the tubing and an equalizing port capable of communicating said circulating passage with the annulus between the tubing and casing;

(b) equalizing valve means movably positioned within said circulating passage and normally closing said equalizing port;

(c) fluid pressure differential responsive valve actuator means being passed through said tubing and moving into passage closing engagement with said equalizing valve means to permit opening of said equalizing valve means responsive to predetermined fluid pressure applied from said tubing to thus permit equalization of tubing and casing pressure and permit pumping of kill fluid through said tubing and through said equalizing port into the annulus between the tubing and casing to kill the well; and (d) yieldable lock means restraining said equalizing valve against movement relative to said body means below a predetermined pressure differential and yielding at said predetermined pressure differential to permit pressure energized movement of said equalizing valve to said open position, said yieldable lock means comprising:

(1) a first lock element yielding at said preselected pressure differential to permit opening of said equalizing valve, and (2) a second lock element being movable into locking engagement with said equalizing valve upon movement of said equalizing valve to a preselected closed position, said second lock element also being yieldable at said preselected pressure differential to permit subsequent opening of said equalizing valve element.

2. A circulating sub as recited in claim 1, wherein said lock means comprises:

a shearable element retaining said equalizing valve in the closed position thereof, said shearable element becoming sheared by the force developed at said preselected pressure differential.

3. A circulating sub as recited in claim 2, wherein said equalizing valve means comprises:

(a) a sleeve valve being positioned for linear movement within said body means; and (b) seal means establishing sealing engagement with said sleeve valve and valve body, said seal means isolating said equalizing port in the closed position of said sleeve valve.

4. A circulating sub as recited in claim 3, wherein said pressure responsive means comprises:

(a) actuating plug means defining shoulder means and capable of passing through said tubing to position said shoulder means in shouldered engagement with said sleeve valve; and (b) actuator valve means within said actuating plug means, said valve means opening to permit flow through said actuating plug during passage of said actuating plug means through said actuator valve means being seated within said actuating plug means by fluid pressure applied from said tubing above said actuator valve means to permit development of pressure differential induced force on said sleeve valve.

5. A circulating sub as recited in claim 3, wherein said actuator valve means comprises:

(a) flow passage means being defined by said actuating plug means;

(b) valve seat means being defined within said actuating plug means about said flow passage means; and (c) a valve ball being movably contained within said flow passage means and adapted for seating engagement with said valve seat means.

6. A circulating sub as recited in claim 5, wherein:

(a) said actuating plug means incorporates normally closed bypass means capable of being opened to communicate the flow passage means thereof with the annulus between said actuating plug and said tubing; and (b) means causing opening of said bypass means.

7. A circulating sub as recited in claim 6, wherein said bypass means comprises:

a frangible bypass plug being received by said plug body and defining blind bypass passage means, said bypass plug being fracturable by tool means extended into said actuating plug means to open said bypass passage.

8. A circulating sub as recited in claim 1, wherein:

(a) said equalizing valve is a sleeve valve being linearly movable within said circulating sub, said sleeve valve defining first and second locking grooves and being positionable at first and second locked positions, (b) said first lock element is shear lock means received within said first locking groove and being sheared by shear force developed at said predetermined pressure differential; and (c) said second lock element is shear lock means receivable within said second locking groove and being sheared by shear force developed at said predetermined pressure differential, said second lock element being out of registry with said second locking groove at said first locked position of said equalizing valve and moving into said second locking groove upon positioning of said equalizing valve at said second locked position thereof.

9. A circulating sub as recited in claim 8, including:

(a) urging means continuously urging said second lock means toward said equalizing valve, (b) said second lock means being maintained in a retracted position by said equalizing valve at said first locked position and being moved by said urging means into said second locking groove upon movement of said equalizing valve to said second locked position.

10. A circulating sub as recited in claim 1, wherein said lock means comprises:

(a) detent means latching said equalizing valve in the closed position thereof; and (b) spring means urging said detent means toward the latching position thereof, said detent means yielding upon application of predetermined force to said equalizer valve to permit opening of said valve and relatching said valve upon subsequent movement of said equalizer valve to the closed position thereof.

11. A circulating sub as recited in claim 1, wherein:

(a) said equalizing valve is a sleeve valve positioned for linear movement within said sub and being positionable at a first closed position, as open position and a second closed position relative to said equalizing port of said body means, said sleeve valve defining first and second locking grooves; and (b) said first and second lock elements are provided in spaced relation on said body means, said first lock element engaging said first locking groove and retaining said equalizing valve at said first closed position thereof, said second lock element being out of registry with said second locking groove at said first closed position of said equalizing valve and being in registry with said second locking groove means at said second closed position of said equalizing valve.

12. A circulating sub as recited in claim 11, wherein:

(a) said first lock element is shear lock means received within said first locking groove and being sheared by shear force developed at said predetermined pressure differential; and (b) said second lock element is shear lock means receivable within said second locking groove and being sheared by shear force developed at said predetermined pressure differential, said second lock element being out of registry with said second locking groove at said first locked position of said equalizing valve and moving into said second locking groove upon positioning of said equalizing valve at said second locked position thereof.

13. A circulating sub as recited in claim 12, including:

(a) urging means continuously urging said second lock means toward said equalizing valve, (b) said second lock means being maintained in a retracted position by said equalizing valve at said first locked position and being moved by said urging means into said second locking groove upon movement of said equalizing valve to said second locked position.

* * * * *